US006622520B1

(12) United States Patent
Prosser et al.

(10) Patent No.: US 6,622,520 B1
(45) Date of Patent: Sep. 23, 2003

(54) CRYOGENIC RECTIFICATION SYSTEM FOR PRODUCING LOW PURITY OXYGEN USING SHELF VAPOR TURBOEXPANSION

(75) Inventors: Neil Mark Prosser, Lockport, NY (US); Minish Mahendra Shah, East Amherst, NY (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

(21) Appl. No.: 10/316,116

(22) Filed: Dec. 11, 2002

(51) Int. Cl.[7] ..... F25J 3/04
(52) U.S. Cl. ..... 62/646; 62/900
(58) Field of Search ..... 62/617, 640, 643, 62/646, 648, 652, 902

(56) References Cited

U.S. PATENT DOCUMENTS

| | | | | |
|---|---|---|---|---|
| 5,337,570 A | | 8/1994 | Prosser | 62/25 |
| 5,463,871 A | | 11/1995 | Cheung | 62/38 |
| 5,475,980 A | | 12/1995 | Grenier et al. | 62/24 |
| 5,582,036 A | | 12/1996 | Drnevich et al. | 62/656 |
| 5,628,207 A | | 5/1997 | Howard et al. | 62/646 |
| 5,669,236 A | * | 9/1997 | Billingham et al. | 62/643 |
| 5,678,427 A | * | 10/1997 | Bonaquist et al. | 62/650 |
| 5,682,766 A | | 11/1997 | Bonaquist et al. | 62/646 |
| 5,836,174 A | * | 11/1998 | Billingham et al. | 62/643 |
| 5,839,296 A | | 11/1998 | Bonaquist et al. | 62/650 |
| 5,901,576 A | | 5/1999 | Agrawal et al. | 62/646 |
| 5,916,262 A | | 6/1999 | Prosser et al. | 62/646 |
| 6,178,775 B1 | | 1/2001 | Higginbotham et al. | 62/646 |
| 6,279,344 B1 | | 8/2001 | Drnevich et al. | 62/646 |

* cited by examiner

*Primary Examiner*—Henry Bennett
*Assistant Examiner*—Malik N. Drake
(74) *Attorney, Agent, or Firm*—Stanley Ktorides

(57) ABSTRACT

A cryogenic rectification system for producing low purity oxygen from an auxiliary column to a double column system and which can also effectively produce nitrogen gas product and/or one or more liquid products wherein the lower pressure column of the double column system is reboiled in part by turboexpanded shelf vapor which is condensed in an intermediate reboiler and preferably subcooled prior to passage into the lower pressure column.

17 Claims, 2 Drawing Sheets

CRYOGENIC RECTIFICATION SYSTEM FOR PRODUCING LOW PURITY OXYGEN USING SHELF VAPOR TURBOEXPANSION

TECHNICAL FIELD

This invention relates generally to the cryogenic rectification of feed air and, more particularly, to the cryogenic rectification of feed air to produce low purity oxygen.

BACKGROUND ART

The demand for low purity oxygen is increasing in applications such as glassmaking, steelmaking and energy production. Low purity oxygen is generally produced in large quantities by the cryogenic rectification of feed air. However, conventional cryogenic rectification systems for producing low purity oxygen are relatively inefficient. Moreover, such conventional systems are not effective when gaseous nitrogen or one or more liquid products are desired.

Accordingly it is an object of this invention to provide a cryogenic rectification system which can more efficiently produce low purity oxygen.

It is another object of this invention to provide a cryogenic rectification system which can efficiently produce low purity oxygen and can also effectively produce gaseous nitrogen product and/or one or more liquid products.

SUMMARY OF THE INVENTION

The above and other objects, which will become apparent to one skilled in the art upon a reading of this disclosure, are attained by the present invention, one aspect of which is:

A method for producing low purity oxygen comprising:

(A) passing feed air into a higher pressure column and separating the feed air within the higher pressure column by cryogenic rectification into nitrogen-enriched vapor and oxygen-enriched liquid;

(B) passing oxygen-enriched liquid into a lower pressure column, condensing a first portion of the nitrogen-enriched vapor, and passing at least some of the resulting condensed first portion nitrogen-enriched liquid into the higher pressure column;

(C) turboexpanding a second portion of the nitrogen-enriched vapor, condensing the turboexpanded second portion of the nitrogen-enriched vapor, and passing the condensed second portion nitrogen-enriched liquid into the lower pressure column;

(D) producing by cryogenic rectification within the lower pressure column nitrogen-richer vapor and oxygen-richer liquid, and passing oxygen-richer liquid from the lower pressure column into an auxiliary column; and (E) producing by cryogenic rectification low purity oxygen within the auxiliary column, and recovering low purity oxygen product from the lower portion of the auxiliary column.

Another Aspect of the Invention Is:

Apparatus for producing low purity oxygen comprising:

(A) a higher pressure column, a lower pressure column having a bottom reboiler and an intermediate reboiler, and means for passing feed air into the higher pressure column;

(B) means for passing fluid from the lower portion of the higher pressure column into the lower pressure column, means for passing fluid from the upper portion of the higher pressure column to the lower pressure column bottom reboiler, and means for passing fluid from the lower pressure column bottom reboiler to the higher pressure column;

(C) a turboexpander, means for passing fluid from the upper portion of the higher pressure column to the turboexpander, means for passing fluid from the turboexpander to the lower pressure column intermediate reboiler, and means for passing fluid from the lower pressure column intermediate reboiler into the lower pressure column;

(D) an auxiliary column and means for passing fluid for the lower portion of the lower pressure column to the upper portion of the auxiliary column; and (E) means for recovering low purity oxygen product from the lower portion of the auxiliary column.

As used herein, the term "feed air" means a mixture comprising primarily oxygen and nitrogen, such as ambient air.

As used herein, the term "column" means a distillation or fractionation column or zone, i.e. a contacting column or zone, wherein liquid and vapor phases are countercurrently contacted to effect separation of a fluid mixture, as for example, by contacting of the vapor and liquid phases on a series of vertically spaced trays or plates mounted within the column and/or on packing elements such as structured or random packing. For a further discussion of distillation columns, see the Chemical Engineer's Handbook, fifth edition, edited by R. H. Perry and C. H. Chilton, McGrawHill Book Company, New York, Section 13, *The Continuous Distillation Process.*

The term "double column" is used to mean a higher pressure column having its upper portion in heat exchange relation with the lower portion of a lower pressure column. A further discussion of double columns appears in Ruheman "The Separation of Gases", Oxford University Press, 1949, Chapter VII, Commercial Air Separation.

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is generally adiabatic and can include integral (stagewise) or differential (continuous) contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin. (K).

As used herein, the term "indirect heat exchange" means the bringing of two fluids into heat exchange relation without any physical contact or intermixing of the fluids with each other.

As used herein, the term "subcooling" means cooling a liquid to be at a temperature lower than the saturation temperature of that liquid for the existing pressure.

As used herein, the term "top" when referring to a column means that section of the column above the column mass transfer internals, i.e. trays or packing.

As used herein, the term "bottom" when referring to a-column means that section of the column below the column mass transfer internals, i.e. trays or packing.

As used herein, the term "reboiler" means a heat exchange device that generates column upflow vapor from column liquid. A reboiler may be located within or outside of the column. A bottom reboiler generates column upflow vapor from liquid from the bottom of a column. An intermediate reboiler generates column upflow vapor from liquid from above the bottom of a column.

As used herein, the terms "turboexpansion" and "turboexpander" mean respectively method and apparatus for the flow of high pressure gas through a turbine to reduce the pressure and the temperature of the gas thereby generating refrigeration.

As used herein, the terms "upper portion" and "lower portion" mean those sections of a column respectively above and below the midpoint of the column.

As used herein, the term "tray" means a contacting stage, which is not necessarily an equilibrium stage, and may mean other contacting apparatus such as packing having a separation capability equivalent to one tray.

As used herein, the term "equilibrium stage" means a vapor-liquid contacting stage whereby the vapor and liquid leaving the stage are in mass transfer equilibrium, e.g. a tray having 100 percent efficiency or a packing element height equivalent to one theoretical plate (HETP).

As used herein, the term "low purity oxygen" means a fluid having an oxygen concentration within the range of from 70 to 98 mole percent.

DETAILED DESCRIPTION

Figure 1:
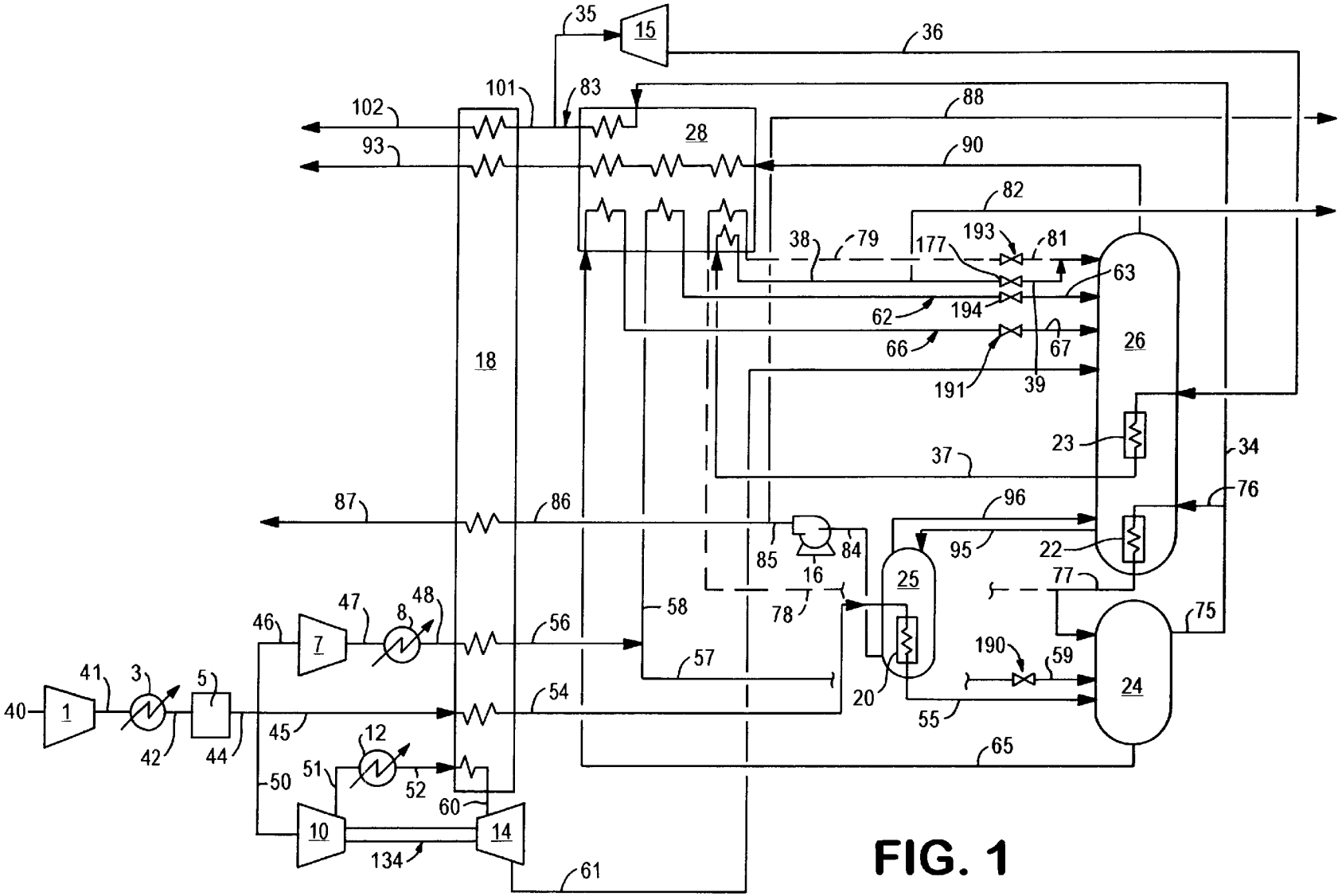
FIG. 1 is a schematic representation of one preferred embodiment of the low purity oxygen cryogenic rectification system of this invention.

The invention will be described in detail with reference to the Drawings. Referring now to FIG. 1, feed air 40 is compressed in feed air base load compressor 1 to a pressure within the range of from 45 to 75 pounds per square inch absolute (psia). Compressed feed air 41 is cooled of the heat of compression in aftercooler 3 and passed in stream 42 to purifier 5 wherein it is cleaned of high boiling impurities such as water vapor, carbon dioxide and hydrocarbons. Resulting cleaned feed air stream 44 is divided into three portions designated 45, 46 and 50. About 3 to 20 percent of feed air 40 is passed in stream 50 to compressor 10 wherein it is compressed to a pressure generally within the range of from 55 to 110 psia. Resulting compressed feed air portion 51 is cooled of the heat of compression by passage through cooler 12 and resulting stream 52 is further cooled by partial traverse of main heat exchanger 18 by indirect heat exchange with return streams. Resulting feed air stream 60 is then turboexpanded by passage through turboexpander 14 to generate refrigeration and resulting turboexpanded feed air stream 61 is passed into lower pressure column 26. The operation of turboexpander 14 serves to drive compressor 10 through shaft 134.

About 24 to 35 percent of feed air 40 is passed in stream 46 to compressor 7 wherein it is compressed to a pressure sufficient to vaporize pumped liquid oxygen in stream 86 as will be more fully described below. This pressure may be within the range of from 75 to 1400 psia. Resulting compressed feed air portion 47 is cooled of the heat of compression by passage through cooler 8 and resulting stream 48 is cooled by passage through main heat exchanger 18 by indirect heat exchange with return streams. Preferably stream 48 is partially condensed, most preferably totally condensed, by passage through main heat exchanger 18. Resulting feed air stream 56 is divided into streams 57 and 58. Stream 57 is passed through valve 190 and as stream 59 into higher pressure column 24. Stream 58 is passed through valve 194 and as stream 63 into lower pressure column 26. Preferably, as shown in FIG. 1, stream 58 is subcooled, such as by passage through heat exchanger or subcooler 28, and passed in stream 62 to valve 194, prior to being passed into lower pressure column 26 in stream 63. The remaining portion of feed air 40 is passed as stream 45 through main heat exchanger 18 wherein it is cooled by indirect heat exchange with return streams. Resulting cooled feed air stream 54 is passed to bottom reboiler 20 of auxiliary column 25 wherein it is partially condensed by indirect heat exchange with auxiliary column bottom liquid as will be more fully described below. The resulting partially condensed feed air is passed in stream 55 into higher pressure column 24 which forms a double column system with lower pressure column 26.

Higher pressure column 24 is operating at a pressure generally within the range of from 40 to 70 psia. Within higher pressure column 24 the feed air is separated by cryogenic rectification into nitrogen-enriched vapor and oxygen-enriched liquid. Oxygen-enriched liquid is withdrawn from the lower portion of column 24 in stream 65, subcooled by passage through heat exchanger 28, passed in stream 66 through valve 191 and, as stream 67, passed into lower pressure column 26. Nitrogen-enriched vapor is withdrawn from the upper portion of column 24 in shelf vapor stream 75. A first portion 76, comprising from about 30 to 50 percent of stream 75, is passed to lower pressure column bottom reboiler 22 wherein it is condensed by indirect heat exchange with lower pressure column bottom liquid. Resulting nitrogen-enriched liquid is withdrawn from bottom reboiler 22 in stream 77 and passed into higher pressure column 24. If desired, a portion, shown by dotted line 78, of stream 77 may be subcooled in subcooler 28 and passed as stream 79 through valve 193 and into lower pressure column 26 in stream 81.

The remaining portion 34 of nitrogen-enriched vapor stream 75 is preferably warmed by partial traverse of subcooler 28 by indirect heat exchange with subcooling oxygen-enriched liquid 65. The resulting warmed nitrogen-enriched vapor stream 83 is divided into streams 101 and 35. Nitrogen-enriched vapor stream 101 is warmed by passage through main heat exchanger 18 and is removed from the system in stream 102 at least a portion of which is preferably recovered as product nitrogen. Nitrogen-enriched vapor stream 35 is passed to turboexpander 15 wherein it is turboexpanded to generate refrigeration. Resulting refrigeration bearing turboexpanded nitrogen-enriched vapor in stream 36 is passed to lower pressure column intermediate reboiler 23 wherein it is condensed by indirect heat exchange with lower pressure column descending liquid thus generating additional upflow vapor for the operation of lower pressure column 26. In the embodiment of the invention illustrated in FIG. 1 intermediate reboiler 23 is shown as being physically within column 26 although it is understood that this reboiler could also be located outside of column 26. Intermediate reboiler 23 vaporizes column liquid taken from above the bottom of column 26, generally from within the range of from 3 to 12 equilibrium stages above the bottom of column 26. Resulting condensed nitrogen-enriched liquid from intermediate reboiler 23 is passed in stream 37 to heat exchanger 28 wherein it is subcooled and from there it is passed into the upper portion of lower pressure column 26 as additional reflux. In the embodiment of the invention illustrated in FIG. 1, the subcooled nitrogen-enriched liquid is withdrawn from heat exchanger 28 in stream 38, passed through valve 177 and then in stream 39 combined with stream 81 for passage into column 26. If stream 81 is not employed, stream 39 is passed directly into lower pressure column 26. If desired, as shown in FIG. 1, a portion 82 of stream 38 may be recovered as product liquid nitrogen typically having a nitrogen concentration within the range of from 98 to 100 mole percent.

Lower pressure column 26 is operating at a pressure less than that of higher pressure column 10 and generally within the range of from 17 to 25 psia. Within lower pressure column 26 the various feeds are separated by cryogenic rectification into nitrogen-richer fluid and oxygen-richer fluid. Nitrogen-richer fluid is withdrawn from the upper portion of column 26 as vapor stream 90, warmed by passage through heat exchangers 28 and 18, and removed from the system in stream 93 which may, if desired, be recovered in whole or in part as product nitrogen.

oxygen-richer fluid, having an oxygen concentration generally within the range of from 60 to 90 mole percent, is passed from the lower portion of lower pressure column 26 into the upper portion of an auxiliary column. In the embodiment of the invention illustrated in FIG. 1, oxygen-richer liquid is withdrawn from the bottom of column 26 in stream 95 and passed into the top of auxiliary column 25 which has a bottom reboiler 20.

The oxygen-richer liquid flows down auxiliary column 25 against upflowing vapor generated by the condensing feed air portion 54, and in the process more volatile components (primarily nitrogen) are stripped out from the downflowing liquid into the upflowing vapor. By this cryogenic rectification stripping process the downflowing liquid forms low purity oxygen liquid at the bottom of auxiliary column 25 which is operating at a pressure generally within the range of from 17 to 25 psia. Vapor from the top of auxiliary column 25 is passed back to lower pressure column 26 in stream 96.

Low purity oxygen fluid is withdrawn from the lower portion of auxiliary column 25 and recovered. The low purity oxygen fluid may be withdrawn from auxiliary column 25 as either vapor or liquid. The embodiment of the invention illustrated in FIG. 1 is a preferred embodiment wherein low purity oxygen fluid is withdrawn as liquid from the lower portion of auxiliary column 25 in stream 84 and increased in pressure to form pumped liquid low purity oxygen stream 85 by passage through liquid pump 16. If desired, a portion of stream 85 may be recovered as liquid low purity oxygen in stream 88. The remaining portion of stream 85, which could be all of stream 85 if no liquid product is recovered, is passed in stream 86 to main heat exchanger 18 wherein it is vaporized by indirect heat exchange with incoming feed air. Resulting vaporized low purity oxygen is recovered as product low purity oxygen gas in stream 87.

The turboexpansion of shelf vapor followed by condensation in the intermediate reboiler provides a benefit when producing elevated pressure nitrogen gas product and/or liquid products in addition to the low purity oxygen product. The shelf turbine/intermediate reboiler arrangement of this invention enables the provision of additional refrigeration with essentially no penalty in mass transfer driving forces because it only reduces mass transfer driving forces in the lower section of the lower pressure column which has an excess mass transfer driving force. Thus the invention enables a reduction in the upper column turbine flow, thereby enabling greater elevated pressure nitrogen gas and/or liquid product recovery. This reduction in upper column turbine flow is better illustrated in the embodiment of the invention illustrated in FIG. 2 wherein the use of feed air stream 50 which is ultimately turboexpanded and passed into the upper column is eliminated. The numerals in FIG. 2 are the same as those of FIG. 1 for the common elements, and these common elements will not be described again in detail.

Figure 2:
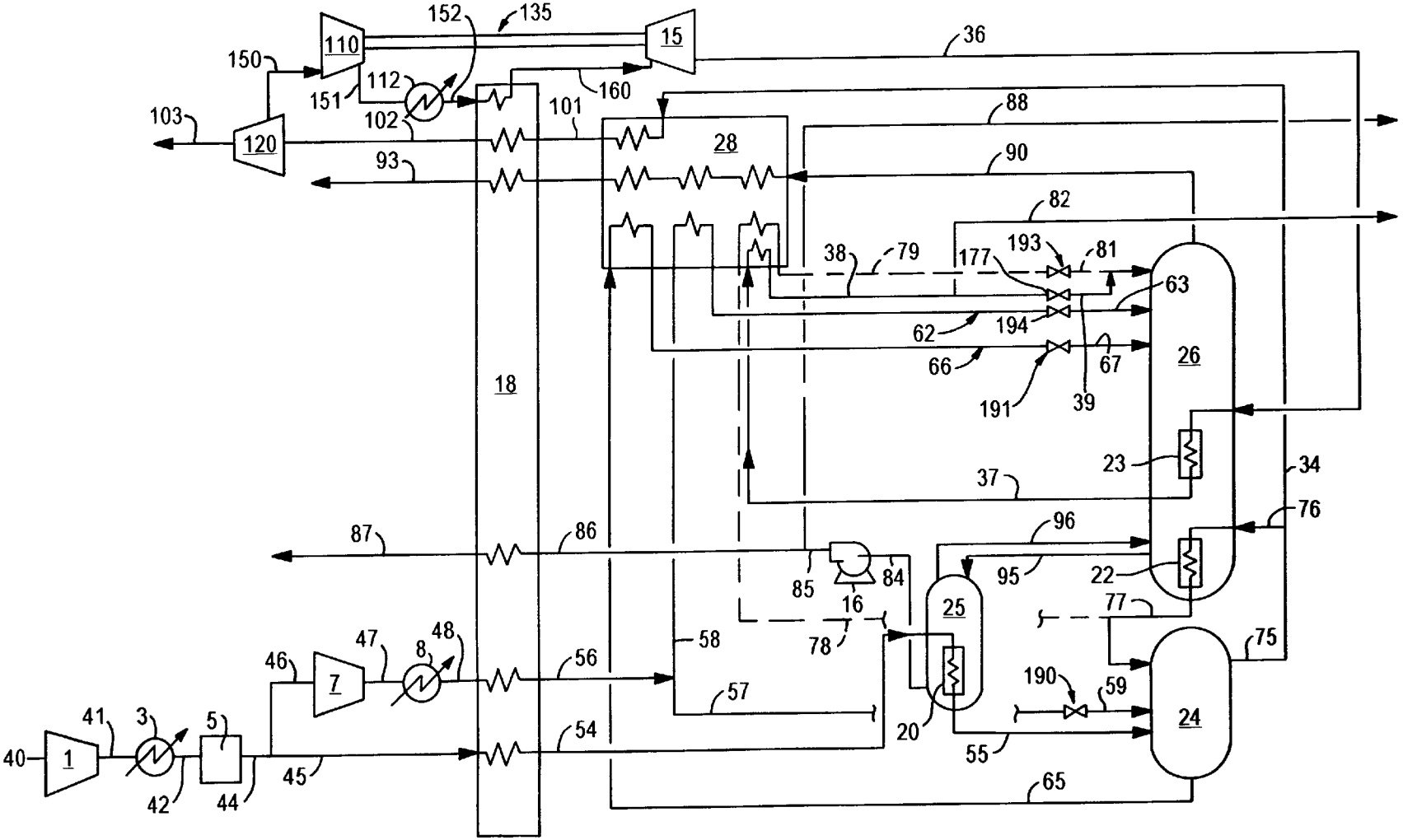
FIG. 2 is a schematic representation of another preferred embodiment of the low purity oxygen cryogenic rectification system of this invention wherein the fluid which drives the intermediate reboiler is compressed prior to being turboexpanded.

In the embodiment of the invention illustrated in FIG. 2, the feed air that would have formed stream 50 remains in stream 45. The increased vapor air flow that follows in column 24 improves the recovery potential of this embodiment, further increasing the amount of elevated pressure nitrogen gas and/or liquids that can be recovered as product.

Referring now to FIG. 2, stream 101 is passed in its entirety to heat exchanger 18 wherein it is warmed to near ambient temperature to form stream 102. Preferably stream 102 is passed through one stage of compression in product compressor 120 which produces compressed nitrogen-enriched gas stream 103 for recovery as product nitrogen gas having a nitrogen concentration within the range of from 98 to 100 mole percent. A portion 150 of stream 102 passed to compressor 120 is withdrawn at an interstage level of compressor 120, preferably after one stage of compression and intercooling in compressor 120. Alternatively side stream 150 could be split off from stream 102 prior to passage to compressor 120 and could be compressed in a single stage compressor or in a single stage of a compressor performing a different function, such as compressor 1 or compressor 7.

After withdrawal from the first stage intercooler, near ambient temperature stream 150 is preferably boosted further in pressure in booster compressor 110, which is powered with energy withdrawn from turboexpander 15 through shaft 135. The heat of compression from resulting stream 151 is removed in aftercooler 112 and resulting stream 152 is cooled by partial traverse of main heat exchanger 18. Resulting stream 160 is turboexpanded by passage through turboexpander 15 to form stream 36 which is passed to intermediate reboiler 23 and further processed in a manner similar to that described with reference to FIG. 1.

Although the invention has been described in detail with reference to certain preferred embodiments, those skilled in the art will recognize that there are other embodiments of the invention within the sprit and the scope of the claims.

What is claimed is:

1. A method for producing low purity oxygen comprising:

(A) passing feed air into a higher pressure column and separating the feed air within the higher pressure column by cryogenic rectification into nitrogen-enriched vapor and oxygen-enriched liquid;

(B) passing oxygen-enriched liquid into a lower pressure column, condensing a first portion of the nitrogen-enriched vapor, and passing at least some of the resulting condensed first portion nitrogen-enriched liquid into the higher pressure column;

(C) turboexpanding a second portion of the nitrogen-enriched vapor, condensing the turboexpanded second portion of the nitrogen-enriched vapor, and passing the condensed second portion nitrogen-enriched liquid into the lower pressure column;

(D) producing by cryogenic rectification within the lower pressure column nitrogen-richer vapor and oxygen-richer liquid, and passing oxygen-richer liquid from the lower pressure column into an auxiliary column; and (E) producing by cryogenic rectification low purity oxygen within the auxiliary column, and recovering low purity oxygen product from the lower portion of the auxiliary column.

2. The method of claim 1 wherein the oxygen-enriched liquid is subcooled prior to being passed into the lower pressure column.

3. The method of claim 2 wherein the second portion of the nitrogen-enriched vapor is warmed by indirect heat exchange with the subcooling oxygen-enriched liquid prior to being turboexpanded.

4. The method of claim 1 wherein all of the condensed first portion nitrogen-enriched liquid is passed into the higher pressure column.

5. The method of claim 1 wherein at least some of the low purity oxygen product is recovered as liquid.

6. The method of claim 1 comprising withdrawing low purity oxygen liquid from the lower portion of the auxiliary column, pumping the withdrawn low purity oxygen liquid to a higher pressure, vaporizing at least some of the pumped liquid low purity oxygen to produce low purity oxygen gas, and recovering the low purity oxygen gas as low purity oxygen product.

7. The method of claim 1 wherein the condensed second portion of the nitrogen-enriched liquid is subcooled prior to being passed into the lower pressure column.

8. The method of claim 1 wherein the second portion of the nitrogen-enriched vapor is compressed to form elevated pressure nitrogen-enriched vapor prior to being turboexpanded.

9. The method of claim 8 wherein a portion of the elevated pressure nitrogen-enriched vapor is recovered as nitrogen gas product.

10. The method of claim 1 further comprising recovering a portion-of the condensed second portion nitrogen-enriched liquid as product liquid nitrogen.

11. Apparatus for producing low purity oxygen comprising:

(A) a higher pressure column, a lower pressure column having a bottom reboiler and an intermediate reboiler, and means for passing feed air into the higher pressure column;

(B) means for passing fluid from the lower portion of the higher pressure column into the lower pressure column, means for passing fluid from the upper portion of the higher pressure column to the lower pressure column bottom reboiler, and means for passing fluid from the lower pressure column bottom reboiler to the higher pressure column;

(C) a turboexpander, means for passing fluid from the upper portion of the higher pressure column to the turboexpander, means for passing fluid from the turboexpander to the lower pressure column intermediate reboiler, and means for passing fluid from the lower pressure column intermediate reboiler into the lower pressure column;

(D) an auxiliary column and means for passing fluid for the lower portion of the lower pressure column to the upper portion of the auxiliary column; and (E) means for recovering low purity oxygen product from the lower portion of the auxiliary column.

12. The apparatus of claim 11 further comprising a subcooler wherein the means for passing fluid from the lower portion of the higher pressure column into the lower pressure column includes the subcooler, and the means for passing fluid from the upper portion of the higher pressure column to the turboexpander includes the subcooler.

13. The apparatus of claim 11 wherein the auxiliary column has a bottom reboiler and further comprising means for passing feed air to the auxiliary column bottom reboiler and from the auxiliary column bottom-reboiler to the higher pressure column.

14. The apparatus of claim 11 further comprising a liquid pump wherein the means for recovering low purity oxygen product from the lower portion of the auxiliary column includes the liquid pump.

15. The apparatus of claim 11 wherein the lower pressure column intermediate reboiler is located within the lower pressure column.

16. The apparatus of claim 11 wherein the lower pressure column intermediate reboiler is located from 3 to 12 equilibrium stages above the bottom of the lower pressure column.

17. The apparatus of claim 11 wherein the means for passing fluid from the upper portion of the higher pressure column to the turboexpander includes a compressor.

* * * * *